US005800901A

United States Patent [19]

Karasawa et al.

[11] Patent Number: 5,800,901

[45] Date of Patent: Sep. 1, 1998

[54] PACKING PAPER FOR BAKER'S YEAST

[75] Inventors: Tsuguo Karasawa; Masayuki Takahashi; Masami Miyamoto, all of Tokyo; Itaru Takayama, Ibaraki, all of Japan

[73] Assignees: Oriental Yeast Co., Ltd.; Nikkan Industries Co., Ltd., both of Tokyo, Japan

[21] Appl. No.: 692,202

[22] Filed: Aug. 5, 1996

[30] Foreign Application Priority Data

Aug. 4, 1995 [JP] Japan ..... 7-200012

[51] Int. Cl.[6] ..... B32B 23/06

[52] U.S. Cl. ..... 428/131; 428/215; 428/340; 428/138; 428/204; 428/486; 428/513; 428/913; 428/341; 428/342; 426/118; 426/127; 426/62

[58] Field of Search ..... 428/215, 340, 428/138, 131, 204, 486, 513, 913, 341, 342; 426/118, 127, 62

[56] References Cited

U.S. PATENT DOCUMENTS

| | | | |
|---|---|---|---|
| 2,927,865 | 3/1960 | Lewis, Jr. et al. | 428/341 |
| 3,844,829 | 10/1974 | Black | 117/65.2 |
| 3,874,905 | 4/1975 | Knights | 117/45 |
| 4,276,340 | 6/1981 | de Leiris | 428/166 |
| 4,380,565 | 4/1983 | Krankkala | 428/182 |
| 5,106,633 | 4/1992 | Edens et al. | 426/8 |

FOREIGN PATENT DOCUMENTS

| | | |
|---|---|---|
| 3004730 | 1/1991 | Japan . |
| 1064036 | 4/1965 | United Kingdom . |

OTHER PUBLICATIONS

Patent Abstract of Japan, Packaging Material, Publication No. 02072074 dated Mar. 12, 1990, Katsutoshi Ando, et al.

Patent Abstract of Japan, Processed Paper Packaging Form for Yeast Cake, Publication No. 03004730, dated Jan. 10, 1991, Akio Sato, et al.

*Primary Examiner*—William P. Watkins, III

*Attorney, Agent, or Firm*—Knobbe, Martens, Olson & Bear, LLP

[57] ABSTRACT

A packing paper for baker's yeast, which is constituted by laminating, on one side of a base paper, at least a printing layer and a wax layer in this order and which has a carbon dioxide permeability of 400–2,000 $cm^3/m^2 \cdot 24$ h·atm., an oxygen permeability of 100–600 $cm^3/m^2 \cdot 24$ h·atm. and a moisture permeability of 50 $g/m^2 \cdot 24$ h or less.

15 Claims, No Drawings

PACKING PAPER FOR BAKER'S YEAST

BACKGROUND OF THE INVENTION

1. Field of the Invention

The present invention relates to a packing paper for baker's yeast cake.

2. Description of the Related Art

The yeast used in bread production has been supplied in various forms. The forms have typically been packed dried granular yeast, packed semi-dried yeast and packed yeast cake.

Yeast cake is produced by cultivating yeast and recovering the proliferated yeast cells in a cake form by filtration or the like, and contains living yeast cells (a major portion) and water. Yeast cake is often molded by an appropriate machine so as to have a desired shape and weight. Yeast cake, requiring no processing steps (e.g. drying step) unlike dry yeast, is available at a low cost and popular for business use.

For packing of yeast cake, there has generally been employed double packing using a wax paper (an outer paper) and a converted paper (an inner paper) in combination.

In conventional packing of yeast cake, there have often occurred various problems during storage and distribution, such as reduction in yeast activity, appearance of tackiness in cake, and appearance of stain (caused by discoloration) on cake surface.

Therefore, packing papers for yeast cake are required to have shield ability of yeast cake from outside and appropriate permeabilities to gases and moisture. In addition to these requirements, it is also important that the packing papers can be produced at a low cost to allow a packed yeast cake to have a low cost and, moreover, can be handled easily. When the packing papers are used for business purpose, they must have good printability for various information and decoration.

However, there has not been developed yet any packing paper for baker's yeast which satisfies the above-mentioned requirements in good balance.

For example, Japanese Patent Application Kokai (Laid-Open) No. 4730/1991 disclosed a converted paper for packing yeast cake, which is constituted by a paper layer and a plastic (e.g. polyethylene) layer formed thereon, which has a $CO_2$ permeability of 450–2,000 cc/m$^2$·h·atm., an $O_2$ permeability of 120–500 cc/m$^2$·h·atm. and a moisture permeability of 200–1,700 cc/m$^2$·h, and which can prevent the appearance of stain on cake surface. However, even this converted paper requires double packing by combination with a wax paper or other converted paper, in view of the prevention of damage during distribution and the necessity of printing; thus, the converted paper is not satisfactory from the standpoint of low-cost packing.

In conventional multiple packing (e.g. double packing), the consumption of paper is large and the amount of waste matter is large; thus, there have been problems from the standpoints of resource saving and disposal of waste matter.

SUMMARY OF THE INVENTION

An object of the present invention is to provide a packing paper for baker's yeast, which can shield yeast cake from outside, has appropriate permeabilities to carbon dioxide, oxygen and moisture in good balance, and thereby can store yeast cake stably; which has good printability for various information and decoration; and which enables low-cost packing.

Other object of the present invention is to provide a packing paper for baker's yeast, which has sufficient packing properties in single packing and which is advantageous from the standpoint of environmental protection (e.g. resource saving and small waste matter amount).

To achieve the above objects, the present invention provides a packing paper for baker's yeast, which is constituted by laminating, on one side of a base paper, at least a printing layer and a wax layer in this order and which has a carbon dioxide permeability of 400–2,000 cm$^3$/m$^2$·24 h·atm., an oxygen permeability of 100–600 cm$^3$/m$^2$·24 h·atm. and a moisture permeability of 50 g/m$^2$·24 h or less.

A layer for reinforcement can be optionally inserted between the printing layer and the wax layer. As this layer for reinforcement, a polyethylene film layer can be preferably used.

The packing paper for baker's yeast according to the present invention can shield yeast cake from outside, has appropriate permeabilities to carbon dioxide, oxygen and moisture in good balance, and resultantly can store yeast cake stably and prevent the appearance of stain on cake surface. Further, since the present packing paper shows a sufficient packing strength in single packing and has good printability for various information and decoration, the present packing paper, as compared with multiple packing, enables simple packing operation, low-cost packing and environmental protection (e.g. resource saving and small waste matter amount).

DETAILED DESCRIPTION OF THE INVENTION AND PREFERRED EMBODIMENTS

In the present packing paper, the constituent materials are selected so that the resulting paper has a carbon dioxide permeability, an oxygen permeability and a moisture permeability in the above specified ranges. Incidentally, oxygen or carbon dioxide permeability was measured by JIS K 7126-1987 [Testing Method for Gas Transmission Rate Through Plastic Films and Sheetings, Method A (Pressure Difference Method), Test Temperature: 23±0.5° C.]; and moisture permeability was measured by JIS Z 0208-1976 [Testing Methods for Determination of the Water Vapor Transmission Rate of Moisture-Proof Packaging Materials (Dish Method), Test Conditions: Temperature=40±0.5° C. and Relative Humidity=90±2%].

The present packing paper for baker's yeast has the above-mentioned properties. Therefore, when yeast cake is packed with the paper, there occur no problems such as (1) reduction in cake weight owing to the vaporization of the water contained in the cake, (2) appearance of specks on cake surface, caused by water droplets, and (3) resultant reduction in commercial value of yeast cake.

The base paper used in the present packing paper can be any paper as long as it can provide a packing paper satisfying the above requirements and can exhibit good handleability in cake-packing operation. It can be, for example, a paper made of natural pulp, a synthetic paper or a semi-synthetic paper, and specific examples thereof are a wood-free paper, a kraft paper, a simili paper and a Japanese paper.

The thickness of the base paper is not particularly restricted as long as required properties are obtained when at least a printing layer and a wax layer have been formed on one side of the base paper. The thickness can be selected in view of the properties, handleability, etc. required for the present packing paper, and is preferably in the range of, for example, 35–80 g/cm$^2$ in terms of weight. When the base paper is too thin, the base paper has low absorbability for the water contained in yeast cake when the base paper is impregnated with a wax, which tends to easily invite the formation of water droplets on yeast cake surface. When the base paper is too thick, the resulting packing paper may have no desired permeabilities to gases and moisture.

A layer for reinforcement can be optionally formed under the wax layer on the printing layer. The material and the thickness of this reinforcing layer are not particularly restricted as long as the required properties of the packing paper according to the present invention are obtained. When a polyethylene film is used as the reinforcing layer, the thickness may be, for example, about 10 to about 20 μm, preferably about 15 μm.

This reinforcing layer may be formed, for example, as a sheet, a net, a mesh or a film having pinholes.

A wax layer is formed on one side of the base paper. The wax layer is made of preferably, for example, at least a paraffin wax and a thermoplastic resin. When a paraffin wax alone is melted and applied onto the base paper, the wax penetrates deep into the base paper fibers and, in some cases, no packing paper having desired properties is obtained. By mixing a thermoplastic resin into the paraffin wax to increase the viscosity of the wax, the above-mentioned problem can be avoided and a wax layer made mainly of a paraffin wax can be formed as a coating layer on the base paper.

The thermoplastic resin mixed into the paraffin wax is not particularly restricted as long as it does not impair the above-mentioned properties required for the present packing paper and further can provide a thickening effect to the paraffin wax. Preferable examples of the thermoplastic resin are an ethylene-vinyl acetate copolymer resin, a polyisobutylene resin, a polystyrene resin because they have excellent compatibility with the paraffin wax and, when mixed with the paraffin wax, can increase the melt viscosity of the paraffin wax. The amount of the thermoplastic resin used is preferably, for example, 5–50 parts by weight per 100 parts by weight of the paraffin wax.

The thickness of the wax layer may be such that the resulting packing paper can have the above-mentioned properties. The thickness is preferably, for example, about 10–30 $g/m^2$ in terms of the amount of wax coated. Incidentally, the total weight of the base paper and the wax layer is preferably 45–110 $g/m^2$.

The packing paper of the present invention can be produced by forming, on one side of a base paper, at least a printing layer and a wax layer in this order. The printing layer can be formed by various methods such as gravure printing, offset rotary printing, flexographic printing and the like. The printing layer can endow the present packing paper with necessary images such as pattern, decoration, trade name, product information and the like.

The wax layer can be formed by heating the constituent materials for melting or softening, then coating the materials on the printing layer formed on the base paper, and cooling the coated materials. The coating can be conducted by various methods using a nip roll coater, a reverse roll coater, a gravure roll coater or the like.

The thus-obtained packing paper of the present invention, when yeast cake is packed therein, can store the yeast cake stably and can prevent the appearance of stain on the cake surface. Further, the present packing paper has a simple constitution, is easy to handle, and is low-priced. Furthermore, the present packing paper has good printability, ensures sufficient storage stability in single packing, promises simple packing operation, and allows low-cost packing.

The present invention is hereinafter described in more detail by way of Example.

Example 1

On one side of a simili paper as the base having a weight of 43.6 $g/m^2$ were printed a desired pattern and desired letters by the use of a gravure printing machine, to partially form a printing layer on the simili paper.

Separately, 80 parts by weight of a paraffin wax (melting point: 130° F.) and 20 parts by weight of an ethylene-vinyl acetate copolymer (Elvacs #250, a product of DuPont) were mixed at 130° C. with stirring. The mixture in a molten state was coated on the entire surface of the base having the above-formed printing layer, in a coated amount of 19.1 $g/m^2$ by the use of a roll coater, followed by cooling, to form a wax layer on the printing layer. Thus, a packing paper for baker's yeast according to the present invention was produced. The packing paper had a weight of 62.7 $g/m^2$.

The packing paper was measured for carbon dioxide permeability and oxygen permeability by JIS K 7126-1987 [Testing Method for Gas Transmission Rate Through Plastic Films and Sheetings, Method A (Pressure Difference Method), Test Temperature: 23±0.5° C.] and also for moisture permeability by JIS Z 0208-1976 [Testing Methods for Determination of the Water Vapor Transmission Rate of Moisture-Proof Packaging Materials (Dish Method), Test Conditions: Temperature=40±0.5° C. and Relative Humidity=90±2%]. The results were as follows.

Carbon dioxide permeability: 1,600 $cm^3/m^2 \cdot 24$ h·atm.

Oxygen permeability: 270 $cm^3/m^2 \cdot 24$ h·atm.

Moisture permeability: 21 $g/m^2 \cdot 24$ h

A yeast cake (water content: about 67 wt. %, pressed yeast: 500 g) was packed with the above packing paper in such a manner that the base paper (the packing paper inside) contacted with the yeast cake. The resulting package was subjected to a test (A) for evaluation of short-term storage stability and a test (B) for evaluation of longer-term storage stability [this test (B) was intended to evaluate the storage stability during ordinary distribution]. Incidentally, the end of the packing paper was sealed with an adhesive tape.

Test condition for test (A)

The package was allowed to stand in air at 30° C. for 4 hours and then stored in a refrigerator of 4° C. for 24 hours.

Test condition for test (B)

The package was stored in a refrigerator of 4C. for 3 weeks.

After the storage, the package was opened to observe the condition of the yeast cake and also measure the weight change of the yeast cake during storage. The results are shown in Table 1. In each of the above tests, the present packing paper generated no speck caused by water droplets, similarly to the case of conventional double packing using a simili type non-sized paper obtained by coating a pure white machine-glazed paper with a 135° F. paraffin wax. Moreover, with the present packing paper, as compared with the double packing, the weight change of yeast cake was very small in each test and the storage stability of yeast cake was very good.

TABLE 1

| Test | Test item | Present packing paper (single packing) | Conventional double packing |
|---|---|---|---|
| (A) | Speck | Not generated | Not generated |
| | Weight change (g) | −1 | −10 |
| (B) | Speck | Not generated | Not generated |
| | Weight change (g) | −9 | −36 |

What is claimed is:

1. A packing paper for baker's yeast, comprising:

a base paper;

a printing layer formed on said base paper; and a wax layer formed on the side of said printing layer away from said base paper where said printing layer is present, wherein said wax layer has a weight of 10–30 $g/m^2$, and said packing paper has a carbon dioxide permeability of 400–2,000 $cm^3/m^2 \cdot 24h \cdot atm.$, an oxygen permeability of 100–600 $cm^3/m^2 \cdot 24h \cdot atm.$ and a moisture permeability of 50 $g/m^2 \cdot 24h$ or less.

2. A packing paper for baker's yeast according to claim 1, wherein the wax layer comprises 100 parts by weight of a paraffin wax and 5–50 parts by weight of a thermoplastic resin.

3. A packing paper for baker's yeast according to claim 1 or 2, wherein the base paper has a weight of 35–80 $g/m^2$.

4. A packing paper for baker's yeast according to claim 1, further comprising a reinforcing layer interposed between the printing layer and the wax layer.

5. A packing paper for baker's yeast according to claim 4, wherein said reinforcing layer is made of polyethylene.

6. A packing paper for baker's yeast according to claim 5, wherein said reinforcing layer has a thickness of 10 μm to 20 μm.

7. A packing paper for baker's yeast according to claim 1, wherein said wax layer is made of a mixture of at least paraffin wax and thermoplastic resin.

8. A packing paper for baker's yeast according to claim 7, wherein said thermoplastic resin is selected from the group consisting of ethylene-vinyl acetate copolymer resin, polyisobutylene resin, and polystyrene resin.

9. A packing paper for baker's yeast according to claim 1, wherein said packing paper has a weight of 45–110 $g/m^2$.

10. A packing paper for baker's yeast according to claim 1, wherein said printing layer is continuously formed or patterned.

11. A packing paper for baker's yeast, comprising:

a base paper; and a wax layer adjacent to said base paper, said wax layer comprising a mixture of paraffin wax and thermoplastic resin, wherein said wax layer has a weight of 10–30 $g/m^2$, and said packing paper has a carbon dioxide permeability of 400–2,000 $cm^3/m^2 \cdot 24h \cdot atm.$, an oxygen permeability of 100–600 $cm^3/m^2 \cdot 24h \cdot atm.$ and a moisture permeability of 50 $g/m^2 \cdot 24h$ or less.

12. A packing paper for baker's yeast according to claim 11, wherein said base paper has a surface which is printed, and the printed surface is adjacent to said wax layer.

13. A packing paper for baker's yeast according to claim 11, further comprising a reinforcing layer interposed between said printed surface and said wax layer.

14. A packing paper for baker's yeast according to claim 13, wherein said reinforcing layer is a sheet, net, mesh, or film with pinholes.

15. A packing paper for baker's yeast according to claim 14, wherein said reinforcing layer is made of polyethylene.

* * * * *